US006328773B1

(12) United States Patent
Beardsley et al.

(10) Patent No.: US 6,328,773 B1
(45) Date of Patent: Dec. 11, 2001

(54) FLEXIBLE ABRASIVE ARTICLE

(75) Inventors: Kris A. Beardsley, Roseville; Rufus C. Sanders, Jr., Burnsville, both of MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 09/421,807

(22) Filed: Oct. 20, 1999

(51) Int. Cl.[7] ..... B24D 3/00; B24D 11/00; B24D 11/02

(52) U.S. Cl. ..... 51/298; 51/295; 51/297; 51/309

(58) Field of Search ..... 51/295, 297, 298, 51/307, 309; 451/526; 428/317.9

(56) References Cited

U.S. PATENT DOCUMENTS

| | | | |
|---|---|---|---|
| 2,958,593 | 11/1960 | Hoover et al. | 51/295 |
| 4,227,350 | 10/1980 | Fitzer | 51/295 |
| 4,652,274 | 3/1987 | Boettcher et al. | 51/298 |
| 4,903,440 | 2/1990 | Larson et al. | 51/298 |
| 5,082,720 | 1/1992 | Hayes | 428/224 |
| 5,236,472 | 8/1993 | Kirk et al. | 51/298 |
| 5,307,593 | 5/1994 | Lucker et al. . | |
| 5,378,252 | 1/1995 | Follensbee | 51/298 |
| 5,565,011 | 10/1996 | Follett et al. . | |
| 5,667,842 | 9/1997 | Larson et al. | 427/258 |
| 5,863,305 | 1/1999 | Beardsley et al. | 51/294 |
| 6,004,363 | 12/1999 | Pisacane et al. | 51/297 |

FOREIGN PATENT DOCUMENTS

| | | |
|---|---|---|
| WO 95/20439 | 8/1995 | (WO) . |
| WO 97/42005 | 11/1997 | (WO) . |
| WO 98/53956 | 12/1998 | (WO) . |
| WO 99/43466 | 9/1999 | (WO) . |

OTHER PUBLICATIONS

U.S. Ser. No. 09/420,968, filed Oct. 20, 1999, entitled, "Flexible Abrasive Article".

Kirk–Othmer "*Encyclopedia of Chemical Technology*", 3rd Edition, John Wiley & Sons, 1981, New York, vol. 17, pp. 384–399 (no month).

*Primary Examiner*—Michael Marcheschi
(74) *Attorney, Agent, or Firm*—Gregory D. Allen

(57) ABSTRACT

The present invention provides a flexible abrasive article containing minimal releaseable amounts of physical and chemical contaminants that may be used to clean surfaces. The abrasive article is made of a foraminous substrate, at least one binder and abrasive particles. Methods of making such abrasive articles are also provided.

21 Claims, 4 Drawing Sheets

FLEXIBLE ABRASIVE ARTICLE

BACKGROUND

This invention is related to abrasive articles, particularly abrasive articles especially suited for use in critical or controlled environments.

An ever increasing number of industrial operations require isolation from potential ubiquitous physical and chemical contaminants. Conversely, other industrial operations may require quarantine from the general environment due to their toxic or infectious nature. Such needs are generally met by the design, fabrication, and use of so-called "clean rooms" (also known as "white rooms").

Such facilities have found widespread use in the manufacture of semiconductor devices, where the presence of external contaminants such as unwanted particles and ions must be minimized. Operations such as, for example, crystal growth, ion implantation, metal deposition, and etching are typically carried out in low pressure (vacuum) chambers or reactors that are operated in clean room environments. Following use for a time, these chambers inevitably become soiled and therefore require cleaning. Depending on the nature of the contamination, abrasive articles may be required to remove tenaciously-held contaminants. Such abrasive operations by definition generate particulate materials that may contaminate the clean room environment. Further, the abrasive articles themselves may convey unwanted particles and/or ionic moieties into the chamber and/or clean room. There thus is a need for an abrasive article for use in critical, clean room environments. Such an abrasive article should efficaciously remove residue from reactor surfaces, minimize the release of particles into the clean room environment, and minimize transfer of ionic contaminants to the reactor and/or the clean room.

SUMMARY OF THE INVENTION

One embodiment of this present invention provides a flexible abrasive article comprising a foraminous substrate, at least one binder, and abrasive particles, wherein the abrasive article contains minimal amount of releaseable physical and chemical contaminants and when used to clean a surface provides a clean workpiece with minimal amounts of physical and chemical contaminants and does not damage the workpiece surface.

Another embodiment of this invention provides a method of making a flexible abrasive article comprising the steps of:

Providing a foraminous substrate;

Coating the foraminous substrate with a make coating;

Coating the coated substrate with abrasive granules;

Curing the granule coated substrate;

Coating the granule coated cured substrate with a size coating;

Curing the size-coated substrate,

Converting the cured, size-coated substrate into useful shaped abrasive article;

Post-cleaning the abrasive articles to remove potential workpiece contaminants; and Packaging the post-cleaned abrasive articles.

"Flexible abrasive article" refers to an abrasive article, which when folded onto itself with the abrasive surface exposed, that does result in knife-edging of the abrasive coating.

"Foraminous substrate" refers to a porous, organic substrate having openings defined by interconnecting voids throughout at least one surface of the substrate. For example, either an open-celled foam substrate or lofty, fibrous, nonwoven web or fabric qualifies as a foraminous substrate.

"Make coat precursor" refers to the coatable resinous adhesive material applied to the coatable surfaces of the openings of the foraminous substrate to secure abrasive particles thereto.

"Make coat" refers to the layer of cured resin over the coatable surfaces of the openings of the foraminous substrate formed by hardening the make coat precursor.

"Size coat precursor" refers to the coatable resinous adhesive material applied to the coatable surfaces of the openings of the foraminous substrate over the make coat.

"Size coat" refers to the layer of cured resin over the coatable surfaces of the openings of the foraminous substrate formed by hardening the size coat precursor.

"Cured" or "fully cured" means a hardened polymerized curable coatable resin.

"Fine abrasive particles" refers to abrasively effective particles comprising any of the materials set forth herein and having distribution of particle sizes wherein a highly preferred median particle diameter is about 60 microns or less. A spherical particle shape is assumed in referring to the median particle diameter, based on standard test methods available for the determination of particle diameters such as, for example, ANSI test method B74.18-1884.

"Substantially uniform" refers to the distribution of fine abrasive particles in the finished articles that are distributed along coatable surfaces of the contours and walls i.e., coatable surfaces, defined by interstices or voids without significant agglomeration of the resin and the particles, as may be visually observed by microscopic examination of the surfaces. In the finished article, the majority of the particles are positioned along the coatable surfaces of the openings to be abrasively effective in the initial application of the article.

The abrasive articles of this invention may be provided in the form of hand pads, endless belts, discs, densified or compressed wheels and the like. Additionally, the articles of the invention may be laminated to other articles such as nonwoven, closed cell foam, open cell foam, or rigid foam substrates and the like or the articles may be provided a in a roll form with or without perforations therein.

In the preparation of the foregoing articles, a foraminous substrate is prepared or is otherwise provided. A make coat precursor composition is applied to a surface of the foraminous substrate to form a first coating layer. A plurality of fine abrasive particles are applied to the first coating layer, and the make coat precursor composition is at least partially cured. Optionally, a size coat precursor composition is applied over the abrasive particles and the first coating layer to form a second coating layer. The first and second coating layers are cured to affix the abrasive particles to the coatable surfaces of the openings of the foraminous substrate to provide the abrasive article wherein the particles are affixed to the surfaces in a substantially uniform distribution along their contours.

The fine abrasive particles are deposited onto the make coat precursor, preferably by depositing the particles first on one major surface of the foraminous substrate and then over the second major surface of the foraminous substrate using the deposition method described in U.S. Pat. No. 5,863,305, incorporated by reference herein. Larger abrasive particles, i.e., greater than 60 micron diameter, are preferably applied to the make coat precursor by known methods such as drop coating or electrostatic coating. Preferably, the make and size coat precursors are thermosetting, coatable, polyurethane resins. Likewise, the optional size coat, when applied to the article, is preferably applied over the at least partially cured make coat. The make coat precursor and size coat precursor are then fully cured to provide the flexible abrasive articles of the invention, and the thus prepared articles may be further processed to provide hand pads, endless belts, discs, densified or compressed wheels and the like.

DETAILED DESCRIPTION OF THE INVENTION

Figure 1:
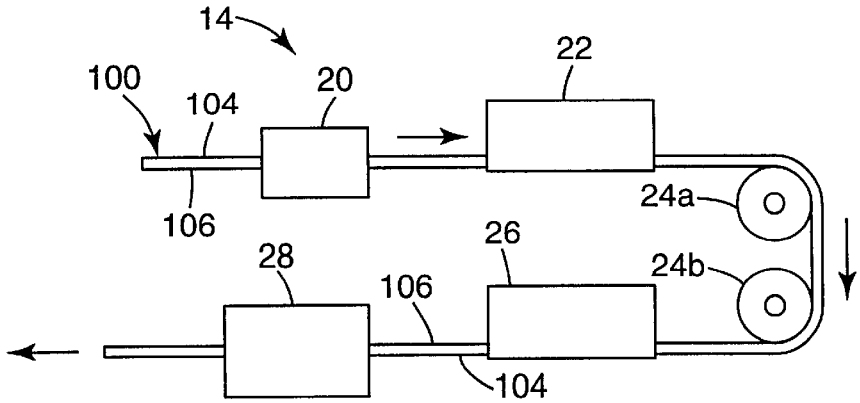
FIG. 1 schematically illustrates a preferred coating process.

The organic substrate used as the support material for the abrasive particles may be a fibrous substrate, such as woven, knitted, or nonwoven fabric. For example, the fibrous substrates include woven, knitted, or nonwoven fabrics such as air-laid, carded, stitch-bonded, spunbonded, wet laid, or melt blown constructions. Alternatively, thermoplastic, thermosetting, or thermoplastic elastomeric foams can be used as the organic substrate. In the event that foam constructions are used, open-celled or reticulated foam structures are preferred.

Nonwoven Substrate

In one embodiment, the organic substrate is an open, lofty, three-dimensional nonwoven fabric, comprising a nonwoven web and fiber adhesive treatment (generally known as "prebond" adhesive). The nonwoven web suitable for use in the articles of the invention may be made of an air-laid, carded, stitch-bonded, spunbonded, wet laid, or melt blown construction. A preferred nonwoven web is the open, lofty, three-dimensional air-laid nonwoven fabric described in U.S. Pat. No. 2,958,593, incorporated herein by reference. The web may be made of any suitable fiber such as nylon, polyester, and the like, capable of withstanding the curing temperatures to which the adhesives are heated without deterioration. Polyester fibers are preferred due to their compatibility with suitable adhesives and their relatively low moisture absorption and therefore commensurate low susceptibility to ionic contamination. The fibers of the web are preferably tensilized and crimped but may also be continuous filaments formed by an extrusion process such as that described in U.S. Pat. No. 4,227,350, incorporated herein by reference.

The fibers used in the manufacture of the nonwoven web include both natural and synthetic fibers and mixtures thereof Synthetic fibers are preferred such as those made of polyester (e.g., poly(ethylene terephthalate)), nylon (e.g., poly(hexamethylene adipamide), polycaprolactam), polypropylene, acrylic (formed from a polymer of acrylonitrile), rayon, cellulose acetate, polyvinylidene chloride-vinyl chloride copolymers, vinyl chloride-acrylonitrile copolymers, and so forth. Natural fibers include those of cotton, wool, jute, and hemp. An important consideration in the selection of the fiber is that it does not melt or decompose at temperatures at or below the melting or curing temperature of the adhesive used as the fiber and abrasive bonding agent. The fiber used may be virgin fibers or waste fibers reclaimed from garment cuttings, carpet manufacturing, fiber manufacturing, or textile processing, and so forth. The fiber material can be a homogenous fiber or a composite fiber, such as bicomponent fiber (e.g., a co-spun sheath-core fiber).

The fineness or linear density of the fiber used may vary widely, depending upon the results desired. Coarse fibers are generally more conducive to making pads for rough scouring jobs, while finer fibers are more appropriate for less aggressive scouring applications. Preferred fibers generally are those having a linear density from about 1 to 25 denier, although finer or coarser fibers may be used depending, for example, on the application envisaged for the finished abrasive article. Those skilled in the art will understand that the invention is not limited by the nature of the fibers employed or by their respective lengths, denier and the like.

The nonwoven web can be formed by a commercially available RANDO-WEBBER device, such as obtained from Rando Machine Co., Macedon, N.Y. With such processing equipment, fiber length ordinarily should be maintained within about 1.25 cm to about 10 cm. However, with other types of conventional web forming equipment, fibers of different lengths, or combinations thereof also can be utilized to form the nonwoven webs. The thickness of the fibers is not particularly limited (apart from processing considerations), as long as due regard is given to the resilience and toughness ultimately desired in the resulting web. With the RANDO-WEBBER equipment, fiber thickness is preferably within a range of about 25 to about 250 micrometers.

The fibers can be curled, crimped and/or straight. However, in the interest of obtaining a three dimensional structure with maximum loft and openness, it is preferable that all or a substantial amount of the fibers be crimped. It will be appreciated that crimping may be unnecessary where the fibers readily interlace with one another to form and retain a highly open lofty relationship in the formed web.

The fibers can be used in the form of a web, a batt, or a tow. As used herein, a "batt" refers to a plurality of air laid webs or similar structures.

As an optional enhancement to a nonwoven abrasive article, it is desirable to promote fiber bonding within the nonwoven web, so that the article will have greater structural strength. Such a fiber treatment can be imparted to the web, preferably as a separate treatment prior to or after the abrasive particles are adhesively attached to the fiber surfaces using the make adhesive. Adhesives known as "prebond" resins, being devoid of abrasive components may be used to further consolidate nonwoven webs. The resinous adhesive is applied to the fibers of the air-laid web as a liquid coating using known coating or spraying techniques followed by hardening of the adhesive (e.g., by heat curing) to thereby bond the fibers of the web to one another at their mutual contact points. Suitable adhesive materials that can be used in this regard are known and include those described in U.S. Pat. No. 2,958,593, incorporated herein by reference. Where melt bondable fibers are included within the construction of the nonwoven web, the fibers may be adhered to one another at their mutual contact points by an appropriate heat treatment of the web to melt at least one of the components of the fiber. The melted component performs the function of an adhesive so that, upon cooling, the melted component will re-solidify and thereby form bonds at the mutual contact points of the fibers of the web. The inclusion of melt bondable fibers (such as those described in U.S. Pat. No. 5,082,720) in a nonwoven web may or may not be accompanied by the application of a prebond resin, as known by those skilled in the art. The selection and use of melt bondable fibers, the selection and application of a prebond resin and the conditions required for bonding the fibers of a nonwoven to one another (e.g., by melt bonding or by prebond resin) are typically within the skill of those practicing in the field.

As mentioned, the fibers are bonded together at their mutual contact points to provide an open, low density, lofty web where the interstices between fibers are left substantially unfilled by resin or abrasive. For typical applications, the void volume of the finished nonwoven abrasive article preferably is in the range of about 75% to about 95%. At lower void volumes, a nonwoven article has a greater tendency to clog-up which reduces the abrasive rate and hinders cleaning of the web by flushing. If the void volume is too high, the web may lack adequate structural strength to withstand the stresses associated with cleaning or scouring operations.

It is also contemplated that the organic substrate may comprise an opened tow of substantially parallel-arranged filaments as the nonwoven flexible abrasive article. In this embodiment, a nonwoven abrasive pad, for example, can be formed by coating an opened tow of filaments with adhesive before or while depositing the abrasive particles on the tow. The adhesive is then subjected to heat treatment to fuse the abrasive particles to the filament surfaces, as described above.

Foam Substrate

The gas phase in a cellular polymer or foam is distributed in interstices or voids called cells. If these cells are interconnected in such a manner that gas can pass from one cell to another, the foam is termed open-celled. In contrast, if the cells are discrete and the gas phase of each is independent of that of the other cells, the foam is termed closed-celled. When the fraction of open cells in a foam is greater than the fraction of closed cells, the foam is an open-celled foam. The closed cell content of a foam may be measured by means of an airflow manometer described in ASTM method D3574.

In general, any resilient and flexible foam substrate having open cells with coatable surfaces on at least one surface of the substrate may be used in the abrasive articles of this invention. Preferred foam substrates have between about 4 to about 100 pores per inch (ppi) (mean pore diameter of 6 to 0.25 mm). Foam substrates having greater than about 100 ppi have surfaces that behave as solid surfaces. Such solid surfaces may be coated by the method of the invention however, such foam substrates may not maintain the properties of the uncoated foam substrate due to non-uniform application of the resin and the particles. Useful foam substrates include those made from synthetic polymer materials, such as polyurethanes, foam rubbers, and silicones, and natural sponge materials.

The thickness of the foam substrate is only limited by the desired end use of the flexible abrasive article. Preferred foam substrates have a thickness that ranges from about 1 mm to about 50 mm.

Preferred foam materials include those that are of polyester urethane, have uniform pores, and have an open, reticulated cell structure. Such preferred foams provide the needed product flexibility and abrasive performance and decrease the propensity for contamination.

Adhesive Binder

As is described in more detail below, an adhesive layer is formed from the application to the foraminous substrate of a resinous make coat precursor or first resin and, optionally, a size coat precursor or second resin applied over the make coat precursor and abrasive particles. Preferably, the adhesive layer is formed from the make coat precursor and the size coat precursor which have been applied to the foraminous substrate at a coating weight which, when hardened, provides the necessary adhesion to strongly bond abrasive particles to the substrate. Make coat and size coat precursors may optionally be frothed or foamed prior to application to the foraminous substrate. In the finished articles of the invention, the adhesive layer provides a thin coating of resin over the abrasive particles without burying the particles within the resin. When observed under a microscope, for example, the individual particles are observed to be anchored to the coatable surfaces of the substrate and to extend outwardly from the outer surfaces of the coatable surfaces. In this construction, the abrasive particles are positioned in the article to be immediately abrasively effective in the initial applications of the finished article. Moreover, the particles are strongly adhered to the coatable surfaces of the interstices to provide an abrasive article with a satisfactory work life.

The make coat precursor suitable for use in the invention is a coatable, hardenable adhesive binder and may comprise one or more thermoplastic or, preferably, thermosetting resinous adhesives. The preferred adhesive binder is that comprising polyurethane due to its flexibility, toughness, and minimal contribution of contaminants and color. Other resinous adhesives suitable for use in the present invention include phenolic resins, aminoplast resins having pendant $\alpha,\beta$-unsaturated carbonyl groups, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof Selection of such resins, however, should be made with great care to avoid the introduction of undesirable amounts of contaminants or the production of friable coatings which tend to produce undesired particulates. Catalysts and/or curing agents may likewise add to the contamination potential of the adhesive binder and should therefore be chosen with care. The make coat dry add-on will typically be between 50 $g/m^2$ and 170 $g/m^2$.

Epoxy resins have an oxirane ring and are polymerized by the ring opening. Such epoxide resins include monomeric epoxy resins and polymeric epoxy reins. These resins may vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol A)] and commercially available materials under the trade designation EPON 828, EPON 1004 and EPON 1001 F available from Shell Chemical Co., DER-331, DER-332 and DER-334 available from Dow Chemical Co. Other suitable epoxy resins include glycidyl ethers of phenol formaldehyde novolac (e.g., DEN-431 and DEN-428 available from Dow Chemical Co.).

Examples of ethylenically unsaturated binder precursors include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof The aminoplast binder precursors have at least one pendant alpha, beta-unsaturated carbonyl group per molecule or oligomer. These materials are further described in U.S. Pat. No. 4,903,440 and U.S. Pat. No. 5,236,472, both incorporated herein by reference.

The ethylenically unsaturated monomers or oligomers may be monofunctional, difunctional, trifunctional or tetrafunctional or even higher functionality. The term acrylate includes both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl) isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, and N-vinylpiperidone.

Isocyanurate derivatives having at least one pendant acrylate group and isocyanate derivatives having at least one pendant acrylate group are further described in U.S. Pat. No. 4,652,274, incorporated herein by reference. The preferred isocyanurate material is a triacrylate of tris(hydroxy ethyl) isocyanurate.

Acrylated urethanes are diacrylate esters of hydroxy terminated isocyanate extended polyesters or polyethers. Examples of commercially available acrylated urethanes include UVITHANE 782, available from Morton Chemical, and CMD 6600, CMD 8400, and CMD 8805, available from UCB Radcure Specialties. Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from UCB Radcure Specialties.

Examples of ethylenically unsaturated diluents or monomers can be found in U.S. Pat. No. 5,667,842 and U.S. Pat. No. 5,236,472, incorporated herein by reference. In some instances these ethylenically unsaturated diluents are useful because they tend to be compatible with water.

Additional details concerning acrylate dispersions can be found in U.S. Pat. No. 5,378,252, incorporated herein by reference.

It is also within the scope of this invention to use a partially polymerized ethylenically unsaturated monomer in the make or size coat precursor. For example, an acrylate monomer can be partially polymerized and incorporated into the make coat precursor. The degree of partial polymerization should be controlled so that the resulting partially polymerized ethylenically unsaturated monomer does not have an excessively high viscosity so that the precursor is a coatable material. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable resin.

In the manufacture of hand pads for use in clean room applications mentioned above, the adhesive materials used as the make coat precursor in the present invention may comprise thermosetting phenolic resins such as resole and novolac resins, described in Kirk-Othmer, Encyclopedia of Chemical Technology, 3d Ed. John Wiley & Sons, 1981, New York, Vol. 17, pp. 384–399. Resole phenolic resins are made with an alkaline catalyst and a molar excess of formaldehyde, typically having a molar ratio of formaldehyde to phenol between 1.0:1.0 and 3.0:1.0. NOVOLAC resins are prepared under acid catalysis and with a molar ratio of formaldehyde to phenol less than 1.0:1.0. A typical resole resin useful in the manufacture of articles of the present invention contains between about 0.75% (by weight) and about 1.4% free formaldehyde; between about 6% and about 8% free phenol, about 78% solids with the remainder being water. The pH of such a resin is about 8.5 and the viscosity is between about 2400 and about 2800 centipoise. Commercially available phenolic resins suitable for use in the present invention include those known under the trade designations DUREZ and VARCUM, available from Occidental Chemicals Corporation, N. Tonawonda, N.Y.; RESINOX, available from Monsanto Corporation; and AROFENE and AROTAP, both available from Ashland Chemical Company; as well as the resole precondensate available under the trade designation BB077 from Neste Resins, a Division of Neste Canada, Inc., Mississauga, Ontario, Canada. Organic solvent may be added to the phenolic resin as needed or desired.

Preferred adhesive materials used in the flexible abrasive articles of the present invention preferably comprise polyurethanes, such as those available commercially from Crompton & Knowles Corporation, Stamford, Conn. under the trade designation ADIPRENE BL16 and ADIPRENE BL31.

The size coat precursor may be the same as the above discussed make coat precursor, or it may be different than the make coat precursor. The size coat precursor can comprise any of the aforementioned resinous or glutinous adhesives such as phenolic resins, urea-formaldehyde resins, melamine resins, acrylate resins, polyurethane resins, epoxy resins, polyester resins, aminoplast resins, and combinations and mixtures of the foregoing. Preferably, the size coat precursor will comprise a resinous adhesive similar or identical to the adhesive used in the make coat precursor. More preferably, the size coat precursor will comprise either a thermosetting resin or a radiation curable resin. The size coat precursor may be foamed prior to its application to the make coat in order to reduce the wet add-on weight of the resin so that the abrasive particles are not buried within the resin coating and rendered unavailable for use in the initial applications of the finished article. The size coat precursor is preferably applied to the foraminous substrate to provide an add-on weight which covers the abrasive particles with a thin and substantially uniform coating without burying the particles under the resin, and is typically within the range from about 50 g/m$^2$ to about 200 g/m$^2$. However, the specific add-on weights will depend on several factors such as the nature of the foraminous substrate as well as the nature of the resin being used. The determination of appropriate size coat add-on weights is well within the skill of those practicing in the field. A preferred size coat is polyurethane.

Abrasive Particles

Useful abrasive particles suitable for inclusion in the abrasive articles of the present invention include all known fine, and larger, abrasive particles having a median particle diameter of from 1 micron to about 600 microns with median particle diameters from about 10 microns to about 100 microns being preferred. More preferably, such fine abrasive particles are provided in a distribution of particle sizes with a median particle diameter of between about 30 microns to about 60 microns. Included among the various types of abrasive materials useful in the present invention are particles of aluminum oxide including ceramic aluminum oxide, heat-treated aluminum oxide and white-fused aluminum oxide; as well as silicon carbide, alumina zirconia, diamond, ceria, cubic boron nitride, garnet, ground glass, quartz, and combinations of the foregoing. Useful abrasive particles may also include softer, less aggressive materials such as thermosetting or thermoplastic polymer particles as well as crushed natural products such as nut shells, for example. Chemically active particles may also be included in the abrasive articles, provided that such chemically active particles do not add objectionable levels of contaminants.

Those skilled in the art will appreciate that the selection of particle composition and particle size will depend on the contemplated end use of the finished abrasive article, taking into account the nature of the workpiece surface to be treated by the article and the abrasive effect desired. Preferably, the fine abrasive particles for inclusion in the articles of the invention comprise materials having a Moh's hardness of at least about 5, although softer particles may be suitable in some applications, and the invention is not to be construed as limited to particles having any particular hardness value. The particles are added to at least one of the first or second major surfaces of the foraminous substrate to provide a particle loading which is adequate for the contemplated end use of the finished article. Abrasive particles may be applied to the foraminous substrate to provide an add-on weight within the range from about 209 to 628 g/m$^2$ (about 50 to 150 grains/24 in$^2$). Preferred abrasive particles are those of fused white alumina because of its relatively low cost and low amounts of contaminants. More preferred abrasive particles are fused white alumina that contains low amounts of sodium, sodium oxides or other sodium derivatives.

Additives

The make coat precursor or the size coat precursor or both can contain optional additives, such as fillers, fibers, lubricants, grinding aids, wetting agents, surfactants, pigments, dyes, coupling agents, photoinitiators, plasticizers, suspending agents, antistatic agents and the like. Such types and amounts of additives that have a potential to increase the presence of contaminants must, however, be strictly avoided. The types and amounts of additives are selected to provide the properties desired, as known to those skilled in the art.

Organic solvent and/or water may be added to the precursor compositions to alter viscosity prior to coating with the caveat that such solvents need to be selected to avoid adding to the contaminant level of the resulting product. The selection of the particular organic solvent and/or water is believed to be within the skill of those practicing in the field and depends upon the thermosetting resin utilized in the make or size precursor and the amounts of these resins utilized.

Method

As seen in FIG. 1, in the preparation of the articles of the invention the foraminous substrate 100 having first side 104 and second side 106 is fed into apparatus 14. The foraminous substrate 100 is first passed through coater 20, which applies first adhesive or make coat precursor to the foraminous substrate 100. The coater 20 can comprise any suitable coater known in the art, such as a spray coater, roll coater, dip coater, knife over roll coater, or the like. When applying make coat precursor described below, the preferred coater 20 comprises a double roll coater with the foraminous substrate 100 passing through the nip formed by the two opposed rollers. Preferably, the pressure of the rollers is controlled so as to control the penetration of the make coat precursor into the thickness of the foraminous substrate. Suitable coaters are well known in the art. The make coat precursor is applied to the bottom roller from a pan as is known in the art. Other suitable arrangements for applying the make coat precursor to the foraminous substrate include but are not limited to applying the make coat precursor with a slot die to the bottom roll or to both rolls of a double roll coater, applying the make coat precursor with a slot die directly to the foraminous substrate prior to entering the nip of a double roll coater, applying the make coat precursor with a slot die without a roll coater and optionally by drawing a vacuum across the foraminous substrate opposite the slot die, applying the make coat precursor to both sides of the foraminous substrate with opposed slot dies with or without subsequently passing the foraminous substrate through a roll coater, and applying the make coat precursor with a hose or duct transversing across the foraminous substrate.

After exiting the first adhesive coater 20, foraminous substrate 100 passes through first particle coater 22. First particle coater 22 is preferably configured to apply fine abrasive particles to the first surface 104 of the foraminous substrate. As explained further below, the abrasive grains will penetrate from surface 104 to some depth into the foraminous substrate 100 depending on the properties of the cells of the foraminous substrate. When it is desired to apply abrasive grains to second side 106 of the foraminous substrate 100, the foraminous substrate passes over rollers **24*a* and 24*b* so as to re-orient the foraminous substrate to have second side 106 facing up. The foraminous substrate 100 then passes through an optional second particle coater 26 configured to apply abrasive particles to the second side 106 of foraminous substrate 100. Preferably, second particle coater 26 is of like construction as first particle coater 22. However, for certain applications, it may be preferable to use second coater 26 of a different type or configuration from first particle coater 22. Also, the second abrasive particle coater 26 may apply abrasive particles having either the same or different composition and/or size as the abrasive particles applied by the first abrasive particle coater 22**. The particles may also be coated onto the foraminous substrate using electrostatic coating techniques.

After applying fine abrasive particles to at least the first surface 104 of foraminous substrate 100, and optionally to second surface 106, the foraminous substrate 100 is preferably exposed to a heat source (not illustrated), such as infrared lamps or an oven, to heat the make coat precursor to the extent necessary to at least partially cure the resin. In some applications, it may be preferable to fully cure the make coat precursor at this step. Heating can be done with any source giving sufficient heat distribution and air flow. Examples of suitable heat sources include forced air oven, convection oven, infrared heat and the like. It is also within the scope of the invention to use radiation or actinic energy. For heat-activatable thermosetting resins, it is preferred that heating be for a sufficient amount of time to drive off residual solvent and initiate at least partial curing of the resin.

In a preferred embodiment, the foraminous substrate 100 optionally passes through second adhesive or size precursor coater 28 to apply an optional but preferred size coat precursor to the foraminous substrate 100 after it exits the second abrasive particle coater 26. Preferably, the size precursor coater is of the same configuration as the make precursor coater 20. For some applications, it may instead be desired to use a coater 28 of a different configuration from that of the first coater 20. In some applications, it may be preferred not to add the size coat.

Figure 2:
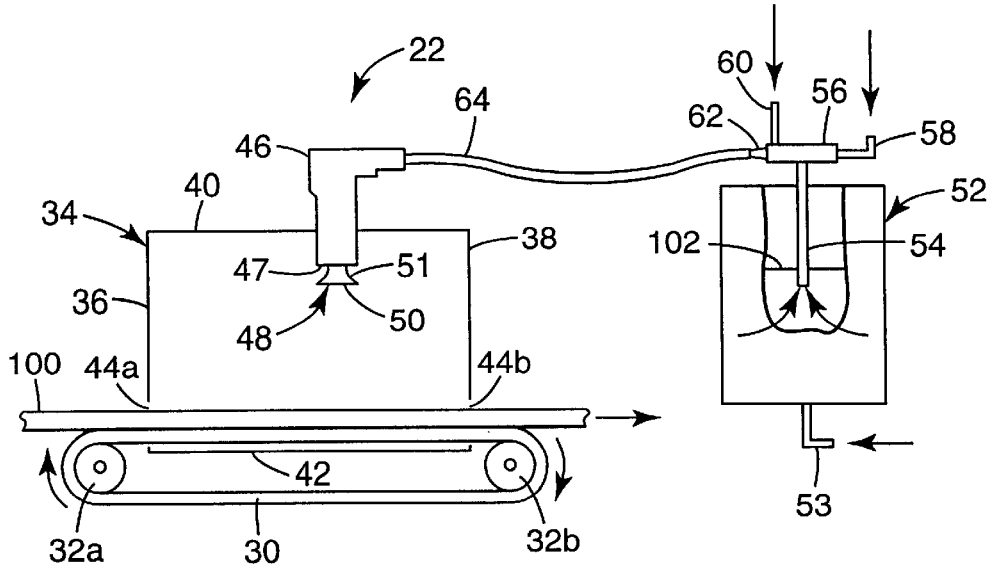
FIG. 2 illustrates a preferred coating apparatus.

A preferred embodiment of first particle coater 22 is illustrated in greater detail in FIG. 2. Foraminous substrate 100 is conveyed through the coater 22 by a carrier belt 30 which passes around rollers 32*a* and 32*b*, at least one of which is a drive roller. The foraminous substrate 100 passes through particle spray booth 34. Booth 34 includes first side 36, second side 38, top 40, and bottom 42. Booth 40 also includes front and back sides not illustrated. First side 36 includes entry slot 44*a* sized and configured to allow foraminous substrate 100 and carrier belt 30 to enter the booth 34. Second side 38 includes exit slot 44*b* sized and configured to allow foraminous substrate 100 and belt 30 to exit the booth 34. Slots 44*a*, 44*b* are located near the bottom of sides 36, 38 respectively. Mounted through an opening in the top 40 of the booth 34 is particle sprayer 46, having deflector 48 mounted at the exit 47 of the sprayer. The foraminous substrate 100, which at this point includes a make coat precursor thereon, is carried by belt 30 through the booth 34. As the foraminous substrate passes from entry slot 44*a* to exit slot 44*b*, particle sprayer 46 introduces particles 102 into the booth so as to coat the first side 104 of the foraminous substrate with abrasive particles. As described below, the particles 102 will penetrate to some depth into the foraminous substrate 100. The foraminous substrate 100, now comprising abrasive particles adhered to the foraminous substrate by the make coat precursor, then exits the booth 34.

In one preferred embodiment, the particle sprayer 46 receives an abrasive particle/air mixture from fluidizing bed 52. Abrasive particles 102 are fluidized in the bed 52 by fluidizing air (from a suitable source, not illustrated), introduced into the bed via fluidizing air inlet 53.

Atop the fluidizing bed 52 is a venturi inlet 56 as is well known in the art. In the illustrated embodiment, venturi 56 receives primary air from a suitable source via primary air inlet 58. The primary air passes through the venturi 56 drawing the mixture of fluidized particles and air through the draw tube 54 which extends from the venturi 56 into the fluidizing bed 52. Secondary air optionally can be added to the venturi inlet 56 via secondary air inlet 60. The secondary air is added to the flow of fluidized abrasive particles after the particles are drawn into the venturi to aid in delivering the fluidized abrasive particle/air mixture to the sprayer 46 via particle hose 64 which extends from the venturi exit 62 to the inlet of the particle sprayer 46.

The deflector 48 mounted in the exit 47 of the particle sprayer 46 redirects the fluidized abrasive particle/air mixture. Deflector 48 includes deflector top 49 (illustrated in FIGS. 4 and 5), deflector bottom 50, and deflector wall 51. In one preferred arrangement, the deflector bottom 50 has a diameter of 32 mm (1.26 inches), the bottom edge of the deflector extends 20 mm (0.79 inches) from the exit of the spray gun, and is held at a height of 155 mm (6.1 inches) above the foraminous substrate 100. Of course, other arrangements fall within the scope of the present invention. For example, the size of the deflector, the shape of the deflector, the contour of wall 51, the number and location of particle sprayers 46, the height of the deflectors above the foraminous substrate, the speed of the foraminous substrate 100, and the air pressure and ratio of abrasive particles in the particle/air mixture may each be varied. Such parameters may be varied to achieve the desired add-on weight of abrasive particles, the desired penetration into the foraminous substrate 100 of the abrasive particles, or the desired uniformity of the abrasive particles 102 on the foraminous substrate 100.

Figure 4:
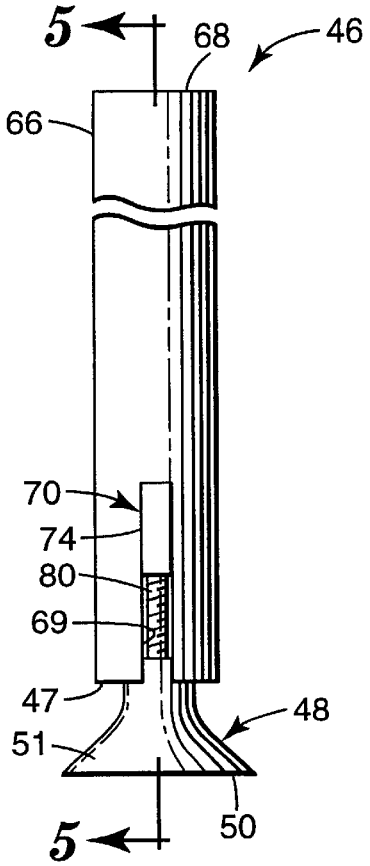
FIG. 4 illustrates a particle coater of the invention.

In one preferred embodiment, sprayer 46, fluidizing bed 52, and controller (not illustrated) is a commercially available system known as MPS 1-L Manual Powder System, including model PG 1-E Manual Enamel Powder Gun, available from Gema, an Illinois Tool Works Company, of Indianapolis, Ind., with a round deflector 48 substantially as illustrated in FIG. 4.

In another preferred embodiment, the abrasive particle spray apparatus is of the type commercially available from Binks Manufacturing Company (Sames), of Franklin Park, Ill., and includes a 50 lb. fluidized bed, a GCM-200 Gun Control Module, a SCM-110 Safety control Module, a STAJET SRV Type 414 gun, with a standard powder pump.

Figure 5:
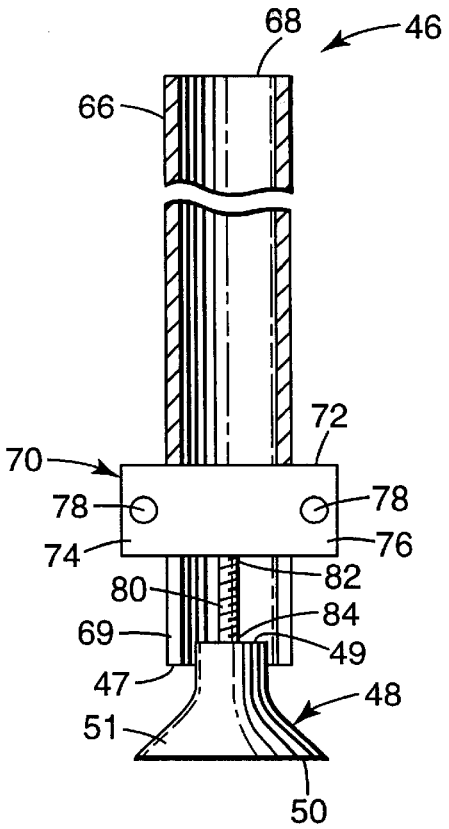
FIGS. 5 and 5*a* illustrate more detail of the particle coater of FIG. 4.

Another preferred embodiment of particle sprayer 46 is illustrated in FIGS. 4 and 5. In this embodiment, the sprayer comprises an elongate tube 66 having an exit 47 at one end and an inlet 68 at the opposite end of the tube. In use, this embodiment of the sprayer 46 has the abrasive particle/air mixture hose 64 attached to the inlet 68 as is illustrated with respect to the earlier described embodiment of FIG. 4. The embodiment of the sprayer 46 illustrated in FIGS. 4 and 5 is mounted in spray booth 34 and operates as described with respect to the embodiment of particle coater 22 illustrated in FIG. 2.

Returning to FIGS. 4 and 5, sprayer 46 includes particle deflector 48 mounted at exit 47 of tube 66. Deflector 48 is mounted to the tube 66 by any suitable mounting means. In one preferred embodiment, deflector mount 70 includes a base 72 comprising a generally rectangular plate having a first end 74 and a second end 76. Base 72 is sized and configured to fit in slot 69 in the end of tube 66 proximate the exit 47. Mount 70 can be permanently or removably mounted to the tube 66. In the illustrated embodiment, base 72 is releasably held in slots 69 by a spring, clip, or other suitable fastener (not illustrated) affixed to holes 78 in the first and second ends of base 72. Extending from base 72 is a threaded rod 80 having a first end 82 affixed to the base (such as by brazing, for example) and second end 84 extending beyond the exit 47 of tube 66. Threaded rod 82 is configured to engage with a like-threaded hole in the top 49 of deflector 48. This allows the position of deflector 48 to be conveniently adjusted with respect to the exit 47 of the tube 66 by rotating the deflector 48. This allows for varying the direction of motion of the particles 102 leaving the sprayer 46 as described above. Deflector 48 also includes bottom 50 opposite top 49, and deflector wall 51 extending between top 49 and bottom 50.

Figure 5A:
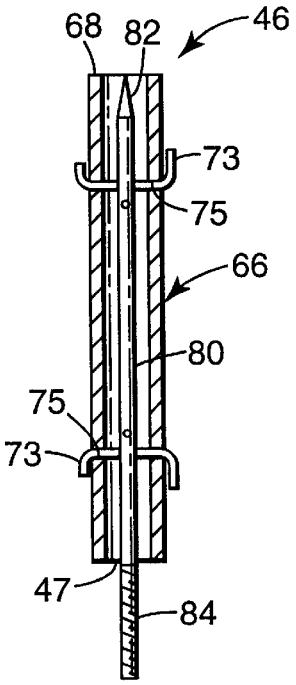

An alternate embodiment of sprayer 46 is illustrated in FIG. 5*a*. In this embodiment, threaded rod 80 is elongated, and includes a tapered end 82 to help direct the flow of abrasive particles through tube 66. Pins 73 extend through holes 75 in the wall of the tube 66, and extend through holes in the rod 80, to mount the rod 80 in the sprayer 46. In one embodiment, the tapered end 82 of rod 80 ends at the inlet 68. In other embodiments, the end 82 can extend beyond the inlet 68, or the inlet may extend beyond the end 82 of the rod. Deflector 48 is mounted on threaded end 84 as described above.

The tube 66 and deflector 48 should be sized and configured to provide the desired uniform spray pattern of abrasive particles 102. In one preferred embodiment, tube 66 is approximately 61 cm (24 inches) long, has an inside diameter of 1.08 cm (0.425 inches), and an outside diameter of 1.27 cm (0.5 inches), and is constructed of stainless steel. It is understood that other sizes and materials of tube 66 fall within the scope of the present invention.

Figure 3:
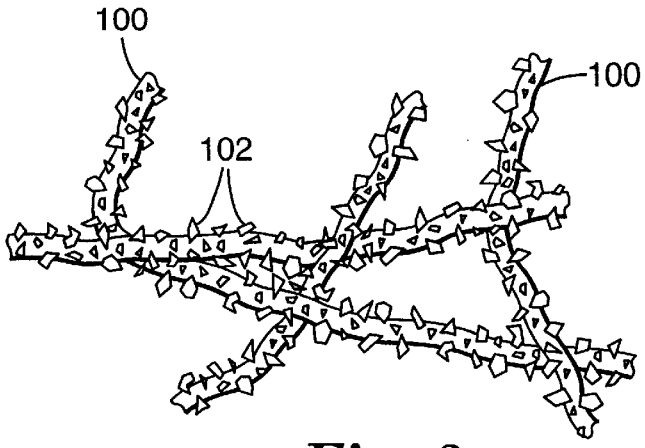
FIG. 3 illustrates a preferred coating on a fibrous nonwoven substrate.
Figure 6:
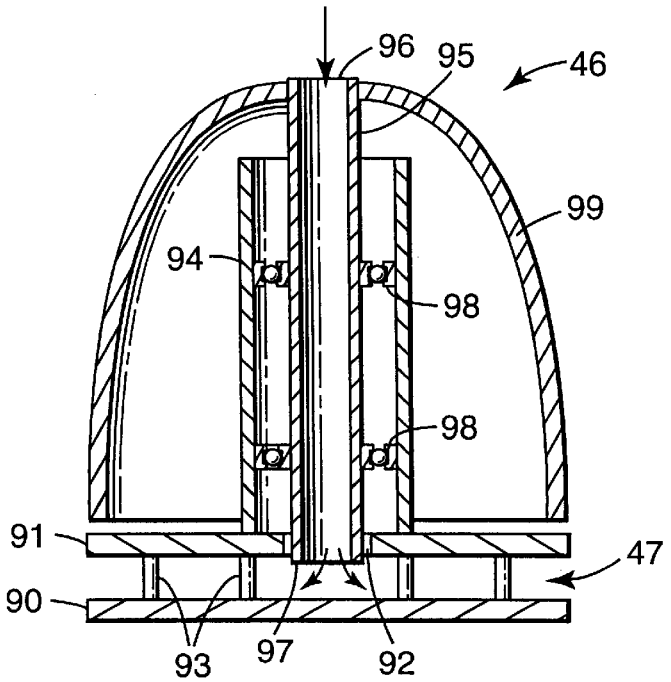
FIG. 6 illustrates an alternative embodiment of a particle coater.
Figure 7A:
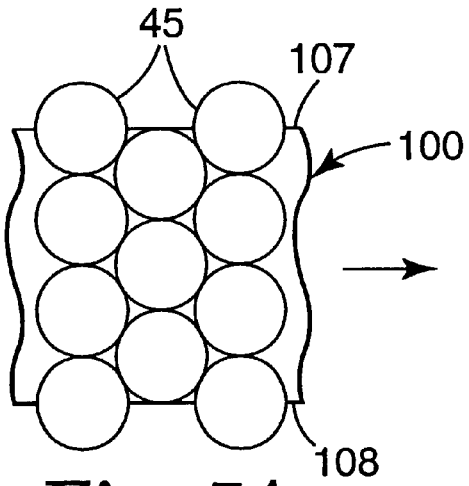
FIGS. 7*a*, 7*b*, 7*c*, and 7*d* illustrate various multiple particle coater arrangement geometries.
Figure 7B:
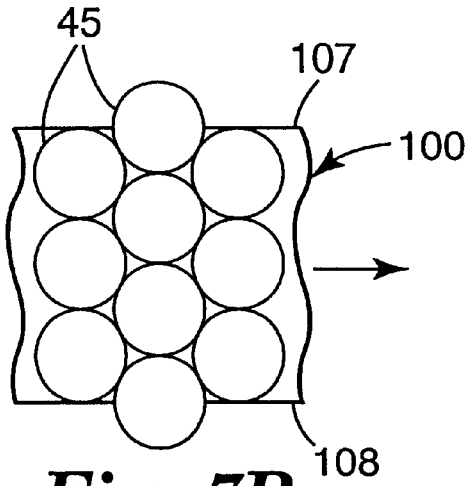
Figure 7C:
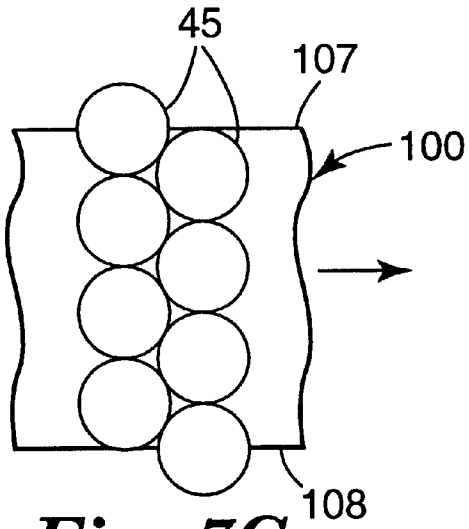
Figure 7D:
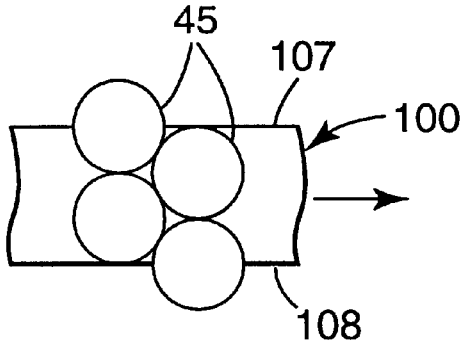
Figure 8:
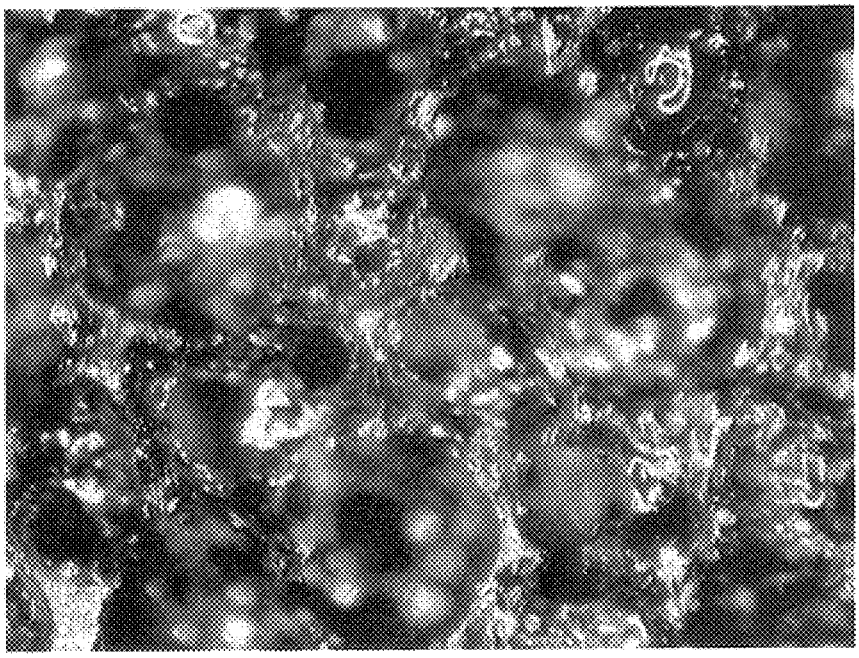
FIG. 8 is a copy of a photograph of a known foam abrasive article.
Figure 9:
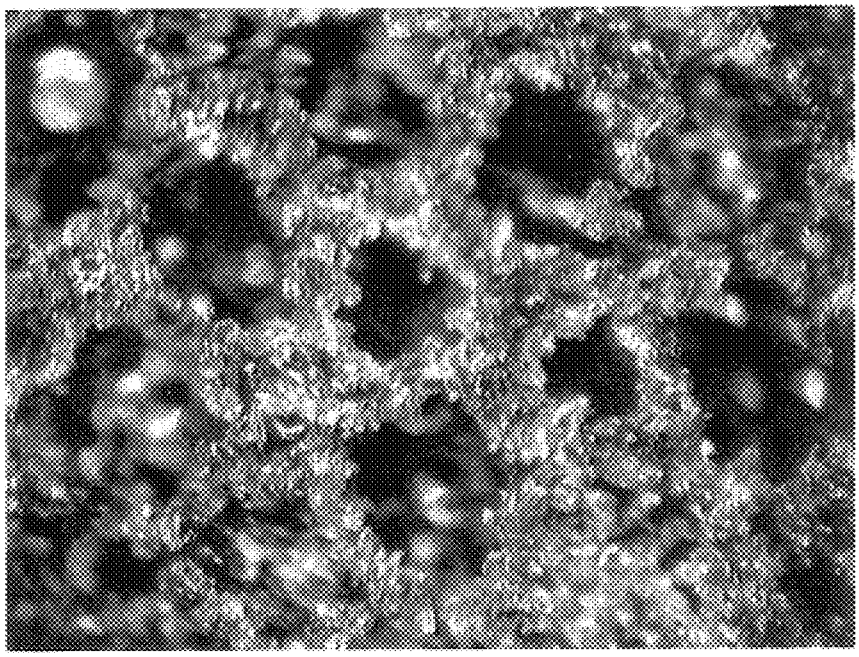
FIG. 9 is a copy of a photograph of a preferred foam abrasive article.

Another preferred embodiment of the abrasive particle sprayer 46 is illustrated in FIG. 6. In this embodiment, the sprayer 46 comprises rotating first and second circular discs 90 and 91, respectively, joined by studs 93. Second disc 91 has a hole 92 in the center thereof. Second disc is joined to rotating shaft 94, which is concentric with the center hole 92. Rotating shaft 94 is rotatably mounted on the outside of stationary feed tube 95 by means of bearings 98, such that rotating shaft 94 is concentric with stationary feed tube 95. In this manner, rotating shaft 94, first plate 90, and second plate 91 are able to rotate together as a unit about stationary feed tube 95. The rotating shaft 94 can be driven by any suitable power means, such as an air motor (not illustrated). Feed tube 95 includes inlet 96 and outlet 97. Inlet 96 of feed tube 95 extends through an opening in housing member 99. In one preferred embodiment, inlet 96 of the feed tube 95 is attached to abrasive particle/air mixture hose 64, and the particle sprayer 46 is mounted on the top 40 of particle booth 34 as explained with regard to the embodiment of FIG. 3. In such an arrangement, the particle sprayer 46 receives fluidized abrasive particles from the fluidizing bed 52. In a variation of this embodiment, a vibratory feeder can be used in place of the fluidizing bed 52. The vibratory feeder is connected to feed abrasive particles into the inlet 96 of feed tube 95.

In operation, the rotating shaft 94 is driven so as to cause plates 90 and 91 to rotate. Fine abrasive particles pass through feed tube 95 and exit from outlet 97. Tube outlet 97 is positioned through hole 92 in second plate 91 such that the abrasive particles enter the space between first and second plates 90, 91. The abrasive particles strike the top surface of rotating plate 90, and will be dispersed through exit 47 in a direction generally parallel to the plane of first and second plates 90, 91. The particles preferably form a cloud that deposits, preferably by settling due to gravity onto the surface of foraminous substrate 100 as explained with regard to the embodiments described above. In one preferred embodiment, particle sprayer 46 comprises a Binks EPB-2000, commercially available from Binks Manufacturing Company (Sames), of Franklin Park, Ill., and the abrasive particles are fed to the particle sprayer by a vibratory pre-feeder commercially available as "Type 151" from Cleveland Vibratory Company, Cleveland, Ohio. The plates 90, 91 of the particle sprayer are preferably driven at 6,000 to 9000 RPM, however slower and faster speeds are within the scope of the present invention. The abrasive particle feed rate, type of particle feeder, or rotational speed of the plates may be selected to provide the desired abrasive particle spray pattern, desired abrasive particle add-on weight, or desired degree of penetration into foraminous substrate 100 of the abrasive particles.

What is common to the preferred embodiments described herein is that the particle sprayer includes means to change the direction of flow of particles 102 exiting the sprayer from perpendicular to the foraminous substrate 100, to a direction approaching, or exceeding, a plane parallel to foraminous substrate 100. Such directions are described with reference to the area immediately surrounding the exit 47 of particle sprayer 46. Thereafter, the fine particles 102 preferably disperse into a cloud of particles in the booth 34. The particles then settle from the cloud onto the foraminous substrate under the influences of gravity. Thus in one preferred embodiment of the inventive method, immediately before the particles adhere to foraminous substrate 100, gravity has a greater effect on the motion of the abrasive particles than does the momentum imparted by the particle sprayer 46. In some applications, the momentum imparted by the particle sprayer 46 will have little or no effect on the motion of the particles 102 immediately before the particles adhere to foraminous substrate 100. In other applications, for example where greater penetration of abrasive particles 102 into the foraminous substrate 100 is desired, the above apparatus parameters and configuration may be selected such that the downward momentum imparted to the particles 102 by the sprayer 46 will have a greater effect on the motion of the particles immediately before the particles adhere to the foraminous substrate.

In the embodiments described with respect to FIGS. 2, 4, and 5, the means for directing the flow of particles 102 exiting the particle sprayer 46 is the deflector wall 51 of deflector 48. Preferably, the location of the deflector 48 relative to the exit 47 of the particle sprayer may be varied to obtain the desired redirection of flow of abrasive particles 102 exiting the particle sprayer. It will be appreciated that without the deflector 48, the abrasive particles exiting the particle sprayer 46 will travel generally parallel to the longitudinal axis of the sprayer, which is generally perpendicular to the foraminous substrate 100. Generally, the closer the wall 51 and bottom 50 of the deflector are to the exit 47, the greater the change in direction of motion of particles 102 from perpendicular to the foraminous substrate 100 will be. Moving the wall 51 and bottom 50 of the deflector further from the exit 47 will reduce the amount the direction of motion of the particles is varied from perpendicular to the foraminous substrate 100. In the embodiment described with respect to FIG. 6, the structure for directing the flow of abrasive particles is the rotating plates 90, 91.

In some applications, it may be desirable to place hard inserts, such as ceramic inserts, into those components of the apparatus 14 that are prone to wear under prolonged flow of abrasive particles through the components. This may be desirable, for example, in the particle sprayer 46, the venturi inlet 56, and the deflector 48. Such inserts would prolong the useful life of certain components of apparatus 14, but would not be expected to have a significant effect on the performance of the apparatus.

For some applications, it is preferable to use a plurality of particle sprayers 46 in a single spray booth 34. Preferably, each of the particle sprayers are of like configuration, however it is understood that different types of particle sprayers could be used in a single booth. The particle sprayers 46 should be arranged in a pattern that provides a uniform coating of abrasive particles 102 to the foraminous substrate 100 as the foraminous substrate passes through the booth 34. This may be accomplished by arranging the plurality of particle sprayers 46 such that each location across the width of the foraminous substrate 100 from first edge 107 to second edge 108 traverses through an equal number of spray patterns 45 caused by each of the particle sprayers 46. Exemplary particle sprayer arrangements are illustrated schematically in FIGS. 7*a* through 7*d*. These figures are schematic top views of the foraminous substrate 100 passing under the spray patterns 45 created by particle sprayers 46 mounted in the top 40 of the booth 34 (not shown). It is possible to vary the flow rates of each of the plurality of sprayers 46, or to use different configurations of sprayers 46 to obtain a desired coating pattern of abrasive particles 102 on foraminous substrate 100. It is also possible to oscillate or reciprocate the particle sprayers 46 to achieve a desired spray pattern as is known in the art.

When using a plurality of particle sprayers 46, it is possible to use a like number of particle coaters 22 as illustrated in FIG. 2, where each particle sprayer receives abrasive particles 102 for a respective fluidizing bed 52. In some applications, it is preferable to feed a plurality of particle sprayers 46 from a single fluidizing bed 50. In one such arrangement, a plurality of venturi injectors 56 is mounted on a single fluidizing bed. In an alternate arrangement, a plurality of volumetric control auger feeders are mounted on the side wall of a fluidizing bed to draw a desired rate of fluidized abrasive particle/air mixture from the fluidizing bed 50. The operation and design of such feeders is well known and need not be further discussed. Each auger feeder deposits the abrasive particles into a venturi injector 56 as described above. Each venturi injector 56 is connected to an abrasive particle/air mixture hose 64 for conveying the abrasive particle/air mixture to a particle sprayer 46 as described above. In one preferred embodiment, the fluidizing bed 50 having a plurality of auger feeders mounted thereon is of the type commercially available as the POWDER DELIVERY CONTROL UNIT from Gema, an Illinois Tool Works Company, of Indianapolis, Ind. It is also within the scope of the invention for the auger feeder to feed abrasive particles from a volumetric feeder of the type commercially available as DRY MATERIAL FEEDER from AccuRate of Whitewater, Wis.

It is also within the scope of the present invention to include additional particle sprayers configured to spray abrasive particles onto the foraminous substrate 100 with enough force to achieve greater penetration into the center portion of the foraminous substrate. Such additional particle sprayers can be included in the spray booth 34 along with the particle sprayers 46 described above, either in the arrangement of particle sprayers 46, or arranged to spray the foraminous substrate 100 before or after the foraminous substrate passes under sprayers 46. Such additional sprayers could also be arranged in a second particle spray booth before or after the sprayers 22, 26, described above. Preferably, the additional sprayers are arranged to deposit abrasive particles onto the foraminous substrate before the sprayers 46, so as not to disturb or disrupt the advantageous spray pattern achieved by the sprayers 46. Such a combination of sprayers may be used to provide a foraminous substrate 100 having the advantageous fine particle distribution at surfaces 104, 106 as described herein, along with particles in the center portion of the foraminous substrate for a longer-life abrasive article.

In one preferred embodiment, the foraminous substrate 100 has a width from first edge 107 to second edge 108 of 61 cm (24 inches) and is fed through apparatus 14 at a foraminous substrate speed of from about 3 to 30 meters/minute (10 to 100 feet/minute), more preferably 16 meters/minute (52.5 feet/minute). The first adhesive coater 20 is a double roll coater with the foraminous substrate 100 passing through the nip formed by the two opposed rollers. The fine abrasive particles 102 are applied by eight particle sprayers 46 generally as described with respect to FIGS. 4 and 5, fed by eight venturi injectors 56 mounted on a fluidizing bed 52. The spray pattern of the injectors is generally as illustrated with respect to FIG. 7*b*. The parameters for the Gema particle coater described above are as follows: fluidizing air introduced through inlet 53 at a pressure of from about 2 to 15 psi; primary air introduced into inlet 58 of venturi 56 at a pressure of up to 90 psi, preferably 30 to 60 psi; secondary air introduced into inlet 60 at a pressure of from 0 to about 90 psi, preferably from 0 to about 20 psi. A size coating precursor may be applied and cured in the same manner as the make coat precursor.

By applying the make coat precursor in the manner described herein, the tendency for the make coat precursor to migrate or concentrate and agglomerate is reduced. In this manner, the coatable surfaces of the substrate are uniformly coated with the make coat precursor, allowing the abrasive particles 102 to be coated onto and adhered to the coatable surfaces in a more uniform distribution. By coating the make coat precursor and abrasive particles in different steps, the abrasive particles are less likely to be "buried" within the make coat as is prone to happen in the prior art method of applying a make coat precursor/abrasive particle slurry. In the finished articles made by the methods and apparatuses of the invention, the size coat provides a thin coating of resin over the fine abrasive particles without burying the particles within the resin. When observed under a microscope, for example, the individual particles are observed to be anchored to the coatable surfaces of the openings and to extend outwardly from the coatable surfaces of the openings. In this construction, the fine abrasive particles are positioned in the article to be immediately abrasively effective in the initial applications of the finished article. Moreover, the particles are strongly adhered to the coatable surfaces of the openings of the foraminous substrate to provide an abrasive article with a satisfactory work life.

Packaging

The abrasive articles are preferably packaged in a Class 100 envrionment conforming to Fed. Std. 209 and Mil. Std. 1246C, Class 100 Particulate Cleanliness Levels.

All packaging materials are certified (e.g., according to Mil. Std. 1246C) for use in such facilities. First the articles are placed in a reduced pressure hood and decontaminated by using a blast of ionized air. The articles are then packaged in an inner wrapping, cleaned with another blast of ionized air, and then overpacked in an outer wrapping.

EXAMPLES

Materials

Foam: polyester polyurethane reticulated foam, 50 cells per inch, 0.375-inch (9.52 mm), illbruck, Inc., Minneapolis, Minn.

PM Ether: propylene glycol monomethyl ether, Lyondell Chemical Company, Houston, Tex.

PM Acetate: propylene glycol monomethyl ether acetate, Arco Chemical Company, Houston, Tex.

BL-16: oxime-blocked isocyanate-terminated polyurethane prepolymer, Crompton & Knowles Corporation, Stamford, Conn.

BL-31: oxime-blocked isocyanate-terminated polyurethane prepolymer, Crompton & Knowles Corporation, Stamford, Conn.

PACM-20: bis(para-aminocyclohexyl)methane, an aliphatic amine curative, Air Products and Chemicals, Inc., Allentown, Pa.

Fiber: polyester staple 15 denier×2", type 224, Hoechst Celanese, Salisbury, N.C.

Mineral A: "P320" SWPL white aluminum oxide, Treibacher, Villach, Austria.

Mineral B: "220 BM" white aluminum oxide, Graystar, Bluffton, S.C.

Mix 1: 62% BL16, 8% PACM20, 30% PM ether (percent liquid weight)

Mix 2: 14% BL16, 39% BL31, 7% PACM20, 40% PM acetate (percent liquid weight)

Mix 3: 50% BL31, 8% PACM20, 42% PM acetate (percent liquid weight)

Biaxial Shake Test

The Biaxial Shake Test was used to determine the propensity of the abrasive articles of the present invention to produce particulate residues or releaseable particles when subjected to vigorous agitation. A 10 cm×10 cm specimen from an abrasive article to be tested was placed in a sealable plastic bucket. 800 ml of COULTER ISOTON solution was added to the bucket. The bucket was sealed and secured into a biaxial motion paint can shaker (Red Devil Inc., Union, N.J.) and the shaker activated for 3 minutes. The bucket was then opened and the specimen removed. A 250 ml aliquot of the solution was then transferred to a COULTER MULTISIZER II Discrete Particle Counter (Coulter Corporation, Miami, Fla.) sample flask. The particle counter was set to perform a 2 ml volumetric particle analysis using a 100 micrometer orifice tube (for the measurement of 2 micrometer to 100 micrometer particles). The total particle count was determined and normalized with respect to the specimen size to obtain releaseable particles per square meter of the abrasive article.

Elemental Analysis

Elemental Analysis was performed by various methods as shown in the following chart:

| Sample Digestion | Analyte | Analysis | Reference |
|---|---|---|---|
| Lithium Borate Fusion | | | ASTM D4503 |
| | Silicon | inductively coupled plasma, mass spectrometry | USEPA 6010B |
| | Aluminum | inductively coupled plasma, mass spectrometry | USEPA 6010B |
| Oxygen Bomb | | | ASTM D808, USEPA 5050 |
| | Halogens | Ion chromatography | ASTM D4327 |
| | Sulphur | Ion chromatography | ASTM D4327 |
| Schoniger Flask Combustion | | | ASTM E442 |
| | Fluorine | Ion selective electrode | ASTM D3869-79 |
| Wet Ash Digestion | | | USEPA 3050 |
| | Sodium | inductively coupled plasma, mass spectrometry | USEPA 6010B |
| | Potassium | inductively coupled plasma, mass spectrometry | USEPA 6010B |
| | Lithium | inductively coupled plasma, mass spectrometry | USEPA 6010B |
| | Silver | inductively coupled plasma, mass spectrometry | USEPA 6010B |
| | Metal Scan | inductively coupled plasma, mass spectrometry | USEPA 6010B |

Dry Schieffer Test

A scuffing test was used to simulate the abrasive qualities of abrasive articles on typical automotive painted surfaces. The test specimens are prepared from poly(methyl) methacrylate sheet material ⅛ inch (3.2 mm) thick, Rockwell Ball Hardness of 90–105, available in 48×96-inch (1.22×2.44 m) sheets under the trade name ACRYLITE from American Cyanamid, Wayne, N.J. Following the removal of the protective covering from the top side of the acrylic sheet, a double coat of PPG BLACK UNIVERSAL BASE COAT paint (PPG Industries Inc., Automotive Finishes Division, Cleveland, Ohio) was applied per the manufacturer's recommendations. The black base coat was painted over with three (3) double coats of PPG PAINT DAU-82, CLEAR (PPG Industries Inc., Automotive Finishes Division, Cleveland, Ohio) per the manufacturer's recommendations, allowing about 30 minutes of"flash time" between each double coat application. The coated sheets were allowed to air-dry for approximately 72 hours. A number of 4-inch (10.2 cm) diameter test specimens were cut from the coated sheet with care taken to minimize the scratching of the painted surface. The cut discs were then baked at 150° F. (66° C.) in an oven, avoiding any contact with the coated surface, for about 16 hours to fully cure the paint coatings. The test specimens were then ready for testing.

The tests were conducted on a Schieffer Abrasion Machine (available from Frazier Precision Company, Gaithersburg, Md.) fitted with a spring clip retaining plate to secure the painted test specimen on the bottom turntable and a mechanical fastener (SCOTCHMATE DUAL LOCK SJ3442 Type 170) to hold the abrasive composition on the upper turntable. For each test, the counter was set to run 500 revolutions. A 4-inch (10.2 cm) diameter disc of the abrasive article to be tested was cut and mounted on the upper turntable via the mechanical fastener. In the event that the abrasive article had contact surfaces significantly different from each other, notation was made as to which side was being tested. A previously-prepared 4-inch (10.2 cm) diameter painted acrylic disc was weighed to the nearest milligram (W(1)) and mounted via the-spring clip to the lower turntable with the painted surface facing up. A 10 lb. (4.55 kg) weight was placed on the load platform of the abrasion tester. If the abrasion tester is plumbed for wet testing, the water supply is shutoff. The upper turntable was lowered to contact the painted acrylic disc under the full force of the load weight, and the machine was started. After 500 revolutions, the machine was turned off, the abrasive article removed from the upper turntable and discarded, and the painted acrylic disc was removed from the lower turntable. Any free dust or detritus was removed from the painted acrylic disc by wiping with a dry paper towel and the disc weighed again (W(2)). The difference W(1)–W(2) is reported to the nearest milligram as "cut".

The test should not abrade the painted acrylic disc to the extent that any of the underlying black paint is removed. In the event that the abrasion progressed through the black layer, the test was repeated. In the event that the abrasion passes through the black layer on the second attempt, new painted acrylic discs should be prepared with additional layers of the clear coating.

Wet Schieffer Test

The Wet Schieffer Test was conducted identically to the Dry Schieffer Test with the exceptions of 1) no paint was applied to the acrylic disk; 2) 2500 cycles were run per test; and 3) a water drip was applied to the workpiece during the test at a rate of about one drop per second.

EXAMPLES

Foam Substrate

Examples A, B, and C

Examples A, B, and C were prepared using an open-cell polyurethane foam as the substrate. The composition of Examples A, B and C are shown in Table 1. The make coat precursor was applied via a two-roll coater.

Example A was cured at 177° C.; 2 minutes for the make coating and 3 minutes for the size coating. Example B was cured at 189° C.; 4 minutes for the make coating and 10 minutes for the size coating. Example C was cured at 175° C.; 6 minutes for the make coating and 12 minutes for the size coating.

TABLE 1

| Example | Foam grains/24 in$^2$ (g/m$^2$) | Make-Mix 1 grains/24 in$^2$ (g/m$^2$) | Make-Mix 2 grains/24 in$^2$ (g/m$^2$) | Size-Mix 1 grains/24 in$^2$ (g/m$^2$) | Size-Mix 3 grains/24 in$^2$ (g/m$^2$) | Mineral A grains/24 in$^2$ (g/m$^2$) | Mineral B grains/24 in$^2$ (g/m$^2$) |
|---|---|---|---|---|---|---|---|
| A | 62 (259) | 44 (184) | — | 64 (268) | — | 84 (351) | — |
| B | 67 (280) | — | 29 (121) | — | 26 (109) | — | 91 (380) |
| C | 65 (272) | 30 (125) | — | — | 35 (146) | 72 (301) | — |

Total Elemental Content

The total elemental content of Example C and comparative commercially available hand pads was determined by a wet ash digestion followed by inductively coupled plasma analysis. The results are shown in Table 2. Appropriate limits are shown in Table 3.

TABLE 2

| | Example C (ppm) | Comparative Example 1 (ppm) | Comparative Example 2 (ppm) |
|---|---|---|---|
| Sodium | 85 | 963 | 1300 |
| Potassium | 5 | 3900 | 1500 |
| Calcium | 2.3 | Major | 23800 |
| Lithium | <1 | 22 | Not determined |
| Chlorine | <47 | 135 | 2300 |
| Copper | <1.4 | 22 | 206 |
| Iron | 4.8 | 1696 | 830 |
| Magnesium | 0.45 | 716 | 390 |
| Titanium | 0.46 | 1461 | 122 |
| Sulfur | 26 | 268 | 1500 |
| Phosphorus | <0.4 | 16 | 820 |
| TOTAL | 174 | 34199 | 32768 |

TABLE 3

| | Preferred (ppm) | Good (ppm) | Maximum Allowable (ppm) |
|---|---|---|---|
| Sodium | 0–50 | 50–200 | <500 |
| Potassium | 0–20 | 20–100 | <500 |
| Calcium | 0–20 | 20–100 | <500 |
| Lithium | 0–20 | 20–50 | <500 |
| Chlorine | 0–50 | 50–100 | <500 |
| Copper | 0–20 | 20–50 | <500 |
| Iron | 0–20 | 20–50 | <500 |
| Magnesium | 0–20 | 20–50 | <500 |
| Titanium | 0–20 | 20–50 | <500 |
| Sulfur | 0–20 | 20–50 | <500 |
| Phosphorus | 0–20 | 20–50 | <500 |
| TOTAL | 0–200 | 200–1000 | <5000 |

Extractables

Extractable objectionable ionic materials were determined for Example B and for commercial hand pads by a one hour deionized water soak followed by ion chromatography. The test methods are described in ASTM D4327 and USEPA 300.1 with the modification that suppression is electrolytic rather than chemical. The results are shown in Table 4 for elected anions and cations in parts per billion. Acceptable limits are shown in Table 5.

TABLE 4

| | Example B (ppb) | Comparative Example 1 (ppb) |
|---|---|---|
| Anions | | |
| Fluoride | * | * |
| Chloride | 7.2 | 11 |
| Nitrite | 0.6 | 2.3 |

TABLE 4-continued

| | Example B (ppb) | Comparative Example 1 (ppb) |
|---|---|---|
| Bromide | * | * |
| Nitrate | 6.7 | 7.1 |
| Phosphate | * | 2.7 |
| Sulfate | 1.6 | 150 |
| TOTAL | 16.1 | 173.1 |
| Cations | | |
| Li | 0.43 | 0.5 |
| Na | 96 | 270 |
| Ammonium | 1.7 | 14 |
| K | 2.1 | 1300 |
| Mg | * | 62 |
| Ca | 26 | 4700 |
| TOTAL | 126.23 | 6346.5 |

*means "not detected"

TABLE 5

| Ranges | Preferred (ppb) | Good (ppb) | Must be (ppb) |
|---|---|---|---|
| Anions | | | |
| Fluoride | 0–1.0 | 1.0–2.0 | <3.0 |
| Chloride | 0–5.0 | 5.0–10.0 | <10.0 |
| Nitrite | 0–1.0 | 1.0–2.0 | <3.0 |
| Bromide | 0–1.0 | 1.0–2.0 | <3.0 |
| Nitrate | 0–5.0 | 5.0–10.0 | <10.0 |
| Phosphate | 0–1.0 | 1.0–2.0 | <3.0 |
| Sulfate | 0–2.0 | 2.0–10.0 | <10.0 |
| TOTAL | 0–20.0 | 20.0–40.0 | <50.0 |
| Cations | | | |
| Li | 0–0.5 | 0.5–1.0 | <5.0 |
| Na | 0–50 | 50–100 | <150 |
| Ammonium | 0–1.0 | 1.0–5.0 | <10.0 |
| K | 0–10.0 | 10.0–30.0 | <50.0 |
| Mg | 0–1.0 | 1.0–5.0 | <100 |
| Ca | 0–10.0 | 10.0–30.0 | <50.0 |
| TOTAL | 0–150 | 150–250 | <300 |

Example A was evaluated for cut by the Dry Schieffer test which was conducted for 500 cycles with a load of 10 pounds. The results are shown in Table 6, wherein acceptable values are greater than or equal to 0.04 gram, preferred values are greater than 0.1 gram, and more preferred values are greater than 0.125 gram.

TABLE 6

| Example | Cut (g) |
|---|---|
| Comparative Example 1 | 0.078 |
| Comparative Example 2 | 0.039 |
| Example A | 0.159 |

Example B was evaluated for cut by the Wet Schieffer test which was conducted with a water drip for 2500 cycles on an acrylic workpiece under a load of 10 pounds, wherein acceptable values must be greater than 2.9 grams, preferred values are greater than 3.2 grams, and more preferred values are greater than 3.6 grams. The test results are shown in Table 7.

TABLE 7

| Example | Cut (g) |
|---|---|
| Comparative Example 1 | 3.6 |
| Comparative Example 2 | 3.2 |
| Example B | 3.0 |

Example A was evaluated for its propensity to produce free particles by the Biaxial Shake Test. The results are shown in Table 8, wherein acceptable values are less than $500\times10^6$ particles per square meter, the preferred range is between $100\times10^6$ and $200\times10^6$ particles per square meter, and more preferred is 0 to $100\times10^6$ particles per square meter.

TABLE 8

| Example | Particles/m$^2$ (millions) |
|---|---|
| Comparative Example 1 | 1213 |
| Comparative Example 2 | 1076 |
| Example A | 136 |

Nonwoven Substrate

Examples D and E

Examples D and E were prepared to demonstrate the invention when using a fibrous nonwoven substrate. Table 9 shows the composition of Examples D and E. Examples D and E were cured at an oven temperature of 350° F.; 2 minutes for the make coating and 3 minutes for the size coating.

TABLE 9

| Example | Fiber grains/24 in$^2$ (g/m$^2$) | Prebond Mix 1 grains/24 in$^2$ (g/m$^2$) | Make Mix 1 grains/24 in$^2$ (g/m$^2$) | Mineral A grains/24 in$^2$ (g/m$^2$) | Size Mix 1 grains/24 in$^2$ (g/m$^2$) |
|---|---|---|---|---|---|
| D | 18 (75) | 27 (113) | 25 (104) | 57 (238) | 45 (188) |
| E | 18 (75) | 27 (113) | 35 (146) | 76 (318) | 53 (222) |

COMPARATIVE EXAMPLES

Comparative Example 1

Comparative Example 1 is a commercially-available nonwoven abrasive surface conditioning material having the trade designation "SCOTCH-BRITE 7447+ General Purpose Hand Pad" available from Minnesota Mining and Manufacturing Company, St. Paul, Minn.

Comparative Example 2

Comparative Example 2 is a commercially available nonwoven abrasive general purpose commercial scouring pad available as "SCOTCH-BRITE #96" from Minnesota Mining and Manufacturing Company, St. Paul, Minn.

Total Elemental Content

The total elemental content of Example D was determined by wet ash digestion followed by ion chromatography. The results are shown as parts per million in Table 10. Acceptable levels of the various components are shown in Table 3 in parts per million parts.

TABLE 10

| | Example D (ppm) | Comparative Example 1 (ppm) | Comparative Example 2 (ppm) |
|---|---|---|---|
| Sodium | 87 | 963 | 1300 |
| Potassium | <1 | 3900 | 1500 |
| Calcium | 4 | Major | 23800 |
| Lithium | <1 | 22 | (unknown) |
| Chlorine | <37 | 135 | 2300 |
| Copper | <1 | 22 | 206 |
| Iron | 11 | 1696 | 830 |
| Magnesium | <1 | 716 | 390 |
| Titanium | <1 | 1461 | 122 |
| Sulfur | 11 | 268 | 1500 |
| Phosphorus | <1 | 16 | 820 |
| TOTAL | 156 | 34199 | 32768 |

Example E was evaluated for cut by the Dry Schieffer test procedure wherein the test was run for 500 cycles under a load of 10 pounds. The results are shown in Table 11. For acceptable articles, the dry cut must be more than 0.04 gram of material removed. Preferred articles cut more than 0.1 gram, and more preferred articles cut more than 0.125 gram.

TABLE 11

| Example | Cut (g) |
|---|---|
| Comparative Example 1 | 0.078 |
| Comparative Example 2 | 0.039 |
| Example E | 0.095 |

Example E was also evaluated for particulate residue using the Biaxial Shake test. The results are shown in Table 12, wherein acceptable values are less than $500\times10^6$ particles per square meter, preferred values are less than or equal to $200\times10^6$ particles per square meter, and more preferred values are less than or equal to $100\times10^6$ particles per square meter.

TABLE 12

| | Particles/m$^2$ (millions) |
|---|---|
| Comparative Example 1 | 1213 |
| Comparative Example 2 | 1076 |
| Example E | 165 |

What is claimed is:

1. A flexible abrasive article comprising abrasive particles adhered to a nonwoven fabric with at least one binder wherein the abrasive article comprises less than 300 ppb collectively of extractable lithium, sodium, ammonium, potassium, magnesium, and calcium cations, and less than $500\times10^6$ releaseable particles per square meter as measured by a Biaxial Shake Test.

2. The abrasive article of claim 1 wherein the abrasive article comprises less than 250 ppb collectively of extractable lithium, sodium, ammonium, potassium, magnesium, and calcium cations.

3. The abrasive article of claim 1 wherein the abrasive article comprises less than 150 ppb collectively of extractable lithium, sodium, ammonium, potassium, magnesium, and calcium cations.

4. The abrasive article of claim 1 wherein the abrasive article comprises less than $200\times10^6$ releaseable particles per square meter as measured by the Biaxial Shake Test.

5. The abrasive article of claim 1 wherein the abrasive article comprises less than $100\times10^6$ releaseable particles per square meter as measured by the Biaxial Shake Test.

6. The abrasive article of claim 1 wherein the abrasive article comprises, on an elemental basis, less than 5000 ppm collectively of sodium, potassium, calcium, lithium, chlorine, copper, iron, magnesium, titanium, sulfur, and phosphorus.

7. The abrasive article of claim 1 wherein the abrasive article comprises, on an elemental basis, less than 1000 ppm collectively of sodium, potassium, calcium, lithium, chlorine, copper, iron, magnesium, titanium, sulfur, and phosphorus.

8. The abrasive article of claim 1 wherein the abrasive article comprises, on an elemental basis, less than 200 ppm collectively of sodium, potassium, calcium, lithium, chlorine, copper, iron, magnesium, titanium, sulfur, and phosphorus.

9. The abrasive article of claim 1 wherein the abrasive article comprises less than 50 ppb collectively of extractable fluoride, chloride, nitrite, bromide, nitrate, phosphate, and sulfate anions.

10. The abrasive article of claim 1 wherein the abrasive article comprises less than 40 ppb collectively of extractable fluoride, chloride, nitrite, bromide, nitrate, phosphate, and sulfate anions.

11. The abrasive article of claim 1 wherein the abrasive article comprises less than 20 ppb collectively of extractable fluoride, chloride, nitrite, bromide, nitrate, phosphate, and sulfate anions.

12. The abrasive article of claim 1 wherein the nonwoven fabric comprises organic fibers and a prebond adhesive.

13. The abrasive article of claim 1 wherein the abrasive particles have a median particle diameter of 10–100 microns.

14. The abrasive article of claim 1 wherein the abrasive particles have a mean particle diameter of 30–60 microns.

15. A method of making a flexible abrasive article comprising:

providing a nonwoven fabric;

coating the nonwoven fabric with a make coating to form a coated substrate;

coating the coated substrate with abrasive particles to form a particle coated substrate;

curing the particle coated substrate;

coating the cured particle coated substrate with a size coating to form a size-coated substrate;

curing the size-coated substrate to provide a flexible abrasive article; and post-cleaning the flexible abrasive article to remove undesired contaminants such that the flexible abrasive article comprises less than 300 ppb collectively of lithium, sodium, ammonium, potassium, magnesium, and calcium cations, and less than $500\times10^6$ releaseable particles per square meter as measured by a Biaxial Shake Test.

16. The abrasive article of claim 1 wherein the abrasive article comprises:

a nonwoven fabric;

a cured make coating on at least a portion of the nonwoven fabric;

abrasive particles adhered to the cured make coating; and a cured size coating on at least a portion of the abrasive particles.

17. The abrasive article of claim 16 wherein the abrasive article contains (a) less than 250 ppb collectively of extractable lithium, sodium, ammonium, potassium, magnesium, and calcium cations, (b) less than $200\times10^6$ releaseable particles per square meter as measured by the Biaxial Shake Test, (c) on an elemental basis, less than 1000 ppm collectively of sodium, potassium, calcium, lithium, chlorine, copper, iron, magnesium, titanium, sulfur, and phosphorus, and (d) less than 40 ppb collectively of extractable fluoride, chloride, nitrite, bromide, nitrate, phosphate, and sulfate anions.

18. The abrasive article of claim 17 wherein the abrasive article contains (a) less than 150 ppb collectively of extractable lithium, sodium, ammonium, potassium, magnesium, and calcium cations, (b) less than $100\times10^6$ releaseable particles per square meter as measured by the Biaxial Shake Test, (c) on an elemental basis, less than 200 ppm collectively of sodium, potassium, calcium, lithium, chlorine, copper, iron, magnesium, titanium, sulfur, and phosphorus, and (d) less than 20 ppb collectively of extractable fluoride, chloride, nitrite, bromide, nitrate, phosphate, and sulfate anions.

19. A post-cleaned flexible abrasive article comprising:

a nonwoven fabric;

a cured make coating on at least a portion of the nonwoven fabric;

abrasive particles adhered to the cured make coating; and a cured size coating on at least a portion of the abrasive particles;

wherein the abrasive article is subjected to a post-cleaning step which results in the article containing less than 300 ppb collectively of extractable lithium, sodium, ammonium, potassium, magnesium, and calcium cations, and less than $500\times10^6$ releaseable particles per square meter as measured by a Biaxial Shake Test.

20. The abrasive article of claim 19 wherein the abrasive article contains (a) less than 250 ppb collectively of extractable lithium, sodium, ammonium, potassium, magnesium, and calcium cations, (b) less than $200\times10^6$ releaseable particles per square meter as measured by the Biaxial Shake Test, (c) on an elemental basis, less than 1000 ppm collectively of sodium, potassium, calcium, lithium, chlorine, copper, iron, magnesium, titanium, sulfur, and phosphorus, and (d) less than 40 ppb collectively of extractable fluoride, chloride, nitrite, bromide, nitrate, phosphate, and sulfate anions.

21. The abrasive article of claim 20 wherein the abrasive article contains (a) less than 150 ppb collectively of extractable lithium, sodium, ammonium, potassium, magnesium, and calcium cations, (b) less than $100\times10^6$ releaseable particles per square meter as measured by the Biaxial Shake Test, (c) on an elemental basis, less than 200 ppm collectively of sodium, potassium, calcium, lithium, chlorine, copper, iron, magnesium, titanium, sulfur, and phosphorus, and (d) less than 20 ppb collectively of extractable fluoride, chloride, nitrite, bromide, nitrate, phosphate, and sulfate anions.

* * * * *

UNITED STATES PATENT AND TRADEMARK OFFICE

CERTIFICATE OF CORRECTION

PATENT NO. : 6,328,773 B1
DATED : December 11, 2001
INVENTOR(S) : Beardsley, Kris A.

It is certified that error appears in the above-identified patent and that said Letters Patent is hereby corrected as shown below:

Column 3,
Line 65, "thereof Synthetic" should read -- thereof. Synthetic --;

Column 6,
Lines 44 and 45, "thereof Selection" should read -- thereof. Selection --; and Column 7,
Line 12, "thereof" should read -- thereof. --.

Signed and Sealed this

Thirty-first Day of December, 2002

JAMES E. ROGAN
*Director of the United States Patent and Trademark Office*